US009220151B2

(12) United States Patent
Feri et al.

(10) Patent No.: US 9,220,151 B2
(45) Date of Patent: Dec. 22, 2015

(54) METHOD FOR CONTROLLING A LIGHTING SYSTEM, AND LIGHTING SYSTEM

(75) Inventors: Lorenzo Feri, Eindhoven (NL); Johan Cornelis Talstra, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 394 days.

(21) Appl. No.: 13/700,809

(22) PCT Filed: May 27, 2011

(86) PCT No.: PCT/IB2011/052316

§ 371 (c)(1),
(2), (4) Date: Nov. 29, 2012

(87) PCT Pub. No.: WO2011/151765

PCT Pub. Date: Dec. 8, 2011

(65) Prior Publication Data

US 2013/0069541 A1 Mar. 21, 2013

(30) Foreign Application Priority Data

Jun. 2, 2010 (EP) ..... 10164692

(51) Int. Cl.
*H05B 37/02* (2006.01)
*H05B 41/46* (2006.01)

(52) U.S. Cl.
CPC ..... *H05B 37/02* (2013.01); *H05B 37/0245* (2013.01); *H05B 41/46* (2013.01)

(58) Field of Classification Search
CPC ..... H05B 37/02; H05B 37/0245; H05B 37/0227; H05B 37/0254; H05B 37/0272; H05B 41/46
See application file for complete search history.

(56) References Cited

U.S. PATENT DOCUMENTS

2004/0201448 A1* 10/2004 Wang ..... 340/3.43
2006/0044152 A1* 3/2006 Wang ..... 340/825
2006/0244624 A1* 11/2006 Wang et al. ..... 340/815.67
2007/0058528 A1 3/2007 Massa et al.
2007/0085701 A1 4/2007 Walters et al.

(Continued)

FOREIGN PATENT DOCUMENTS

EP 2320713 A2 5/2011
JP 2004063216 A 2/2004

(Continued)

OTHER PUBLICATIONS

Huadong, Li. "Development and research of lighting system based on DALI". Industrial Electronics and Applications, 2008. ICIEA 2008, 3rd IEEE Conference, Piscataway, NJ, Jun. 3, 2008 pp. 1302-1307.

(Continued)

*Primary Examiner* — Jung Kim
(74) *Attorney, Agent, or Firm* — Meenaksky Chakravorty

(57) ABSTRACT

The invention relates to a method for controlling a lighting system, said lighting system comprising a plurality of luminaires (10, 12, 14, 16, 18), a plurality of sensors (24, 26), a central control unit (22) and a network (20) comprising networking devices for establishing a communication between the luminaires, the sensors and the central control unit. These luminaires, sensors and networking devices represent local units of the lighting system. In a standard operation mode, the luminaires (10, 12, 14, 16, 18) are controlled by the central control unit (22) on the basis of sensor data transmitted to the central control unit (22). In case of failure of operation of the central control unit (22), the lighting systems switches into a fallback mode, wherein each luminare (10, 12, 14, 16, 18) is controlled by a local unit associated to or represented by this luminaire (10, 12, 14, 16, 18).

6 Claims, 2 Drawing Sheets

(56) References Cited

U.S. PATENT DOCUMENTS

| | | | | |
|---|---|---|---|---|
| 2007/0104146 | A1 | 5/2007 | Hossain et al. | |
| 2008/0304478 | A1 | 12/2008 | Bittnar et al. | |
| 2009/0021955 | A1 * | 1/2009 | Kuang et al. | 362/479 |
| 2009/0278479 | A1 | 11/2009 | Platner et al. | |

FOREIGN PATENT DOCUMENTS

| | | | |
|---|---|---|---|
| JP | 2004185877 | A | 7/2004 |
| JP | 2008523576 | A | 7/2008 |
| JP | 2009158280 | A | 7/2009 |
| WO | 2005018160 | A1 | 2/2005 |
| WO | 2009156900 | A1 | 12/2009 |

OTHER PUBLICATIONS

Dali Manual 2001. Dali AG, pp. 1-62; p. 11, paragraph 2.2—p. 12; p. 23, paragraph 4.6—p. 24; paragraph 4.7; p. 28, paragraph 5.2.1—p. 30; paragraph 5.2.2; figure 5.5. Frankfurt, Germany.

* cited by examiner

METHOD FOR CONTROLLING A LIGHTING SYSTEM, AND LIGHTING SYSTEM

FIELD OF THE INVENTION

The invention relates to the field of lighting systems, especially to a method for controlling a lighting system comprising a plurality of luminaires that are, for example, arranged in the different rooms of the building or in an outdoor area.

BACKGROUND OF THE INVENTION

With the advent of digital lighting control networks, lighting control systems for professional applications, e.g. for office buildings, have become very sophisticated. The different luminaires disposed in the rooms of the building can be controlled on the basis of sensor data so that each individual luminaire can be controlled to produce the required lighting situation. The control is performed by a central control unit responsible for all luminaires of the lighting system. The sensor data are received by the central control unit that sends control commands to the respective luminaires. For this purpose the central control unit comprises processing means to perform an algorithm to compute the control commands. These processing means may also include a memory for storing necessary data, configuration values, addresses and physical locations of the sensors and of the luminaires to which the control commands are sent, and so on.

The luminaires, the sensors and the central control unit are connected by a network that establishes a communication between these elements of the lighting systems. This architecture is shown schematically in FIG. 1. Each luminaire 10, 12, 14, 16, 18 is connected to the network 20, as well as the central control unit 22, to establish a communication between the luminaire 10, 12, 14, 16, 18 and the central control unit 22. Moreover, sensors 24, 26 are arranged to send sensor data via the network 20 to the central control unit. On the basis of these sensor data, a central control unit 22 computes control commands for each luminaire 10, 12, 14, 16, 18. It is noted that each sensor 24, 26 is associated to at least one luminaire 10, 12, 14, 16, 18, i.e. the respective luminaires 10, 12, 14, 16, 18 receive control commands by the central control unit 22 that are computed on the basis of sensor data of their associated sensors 24, 26. For example, one sensor 24 is arranged in one room where his respective associated luminaires 10, 12 are disposed. On the basis of the sensor data of this sensor 24, the luminaires 10, 12 are controlled. Another sensor 26 in another room is arranged for providing sensor data to control the respective luminaires 16, 18 in this room, etc.

The network 20 can be represented, for example, by an IP (Internet Protocol) Network so that each element, i.e. the central control unit 22, the luminaires 10, 12, 14, 16, 18 and the sensors 24, 26 can communicate to any other device, and each unit is provided with an individual IP address. However, any other suitable network types or architecture can be used in this context.

The use of one single central control unit 22 to control multiple luminaires 10, 12, 14, 16, 18 provides a number of advantages in view of costs and configuration flexibility. However, there is a serious disadvantage in view of robustness of the communication architecture. In case the central control unit fails to operate, all luminaires usually controlled by the central control unit during standard operation are without control. On the other hand, the provision of a "backup" central control unit would increase the costs and the complexity of the lighting control system in an unacceptable way. Moreover, such a backup control unit would be of no use in the case of a failure or breakdown of the network communication between the central control unit and the luminaires or sensors.

SUMMARY OF THE INVENTION

It is an object of the present invention to provide a lighting system and a method for controlling such a lighting system that provides higher stability and robustness than the known lighting systems using one single central control unit but keeps their advantages in view of costs and simplicity.

This object is achieved by a method for controlling a lighting system according to claim 1, and a corresponding lighting system according to claim 8.

The method according to the present invention refers to a lighting system comprising a plurality of luminaires that can be controlled by a central control unit on the basis of the input from a plurality of sensors, these components being connected by a network establishing a communication between the luminaires, the sensors and the central control unit. In a standard operation mode, the luminaires receive control commands from the central control unit that are transmitted via the network. These control commands are provided on the basis of sensor data transmitted from the sensors to the central control unit via the network. It is understood that only relevant sensor data are used for providing control commands to control corresponding luminaires, i.e. there is a certain relation between the sensors and the luminaires. For example, a luminaire in one given room receives control commands that are computed on the basis of sensor data provided by a sensor that detects the lighting conditions of the same room. This means that there can be a spatial relation between the luminaires and their associated sensors.

This standard operation mode described above represents an operation of the lighting system wherein the central control unit keeps its functionality to receive sensor data and to compute and to send control commands to the luminaires. However, in case of failure of operation of the central control unit, the lighting systems switches automatically into a fallback mode wherein the control of the luminaires is taken over by local fallback control units (FCU) which are allocated in the luminaires or the sensors. The local fallback control units can be for example implemented in the form of control algorithms (i.e. fallback control algorithms) stored in a local memory of the luminaires or sensors. Moreover, the local fallback control can be represented by a hardware device implemented into the respective luminaire or sensor and being provided to perform a respective fallback control algorithm, as mentioned before. As one alternative, in the case of failure of operation of the central control unit, the fallback control unit is allocated in the luminaire and each luminaire is able to operate on its own on the basis of control commands generated by its local FCU. According to another alternative, the FCU taking over the control of a given luminaire is allocated in the sensor associated to this luminaire, controlling the luminaire in the fallback mode on the basis of his sensor data and sending control commands via the network to the luminaire. Not only a set of control commands but also the (IP) address of the associated luminaire can be stored in the FCU of this sensor.

In both examples mentioned above, no central control unit is necessary to provide the control of the luminaires. Moreover, it is not necessary to provide any "backup" control units as additional devices to be implemented into the lighting system, which would lead to additional costs and a more complicated architecture of the system.

According to one embodiment of the present invention, in the case of the fallback control unit being allocated in the luminaire, this luminaire is controlled in the fallback mode on the basis of sensor data received from a sensor whose network address is stored in the FCU of the luminaire.

These sensor data can be transmitted to the respective associated luminaire via the network without use of the central control unit, which is out of operation or reach so that the fallback mode is activated. It is noted that the local control functionality provided by the FCU of the luminaire can be reduced with respect to the control functionality of the central control unit, for example, by comprising only basic functions of the luminaire. For example, this reduced functionality can comprise control commands to set the luminaire into an on/off state, while the functionality of the central control unit enables more sophisticated control functions to control the behaviour of the lighting system.

In this embodiment, before starting the operation of the lighting system, the fallback control unit is preferrably configured in a commissioning phase. During this commissioning phase, the network address of the associated sensor from which the sensor data are received are preferably stored in the memory of the FCU of the luminaire. This operation can be manual or automatic.

According to another embodiment of the present invention, in the case of said fallback control unit being allocated in a sensor associated to a luminaire to be controlled by this sensor, this luminaire is controlled in the fallback mode on the basis of sensor data provided by this sensor, the network address of the luminaire to be controlled being stored in the FCU of the sensor.

In this embodiment the FCU of the sensor calculates control commands that are transmitted to the associated luminaire via the network.

Before starting the operation of this lighting system, the fallback control unit is preferrably configured in a commissioning phase. During the commissioning phase the network address of a luminaire to be controlled by a sensor is preferably stored in the memory of the FCU of this sensor. This operation can be manual or automatic.

Preferably the central control unit regularly sends an information signal to a luminaire or a sensor equipped with the fallback control unit indicating the operational status of the central control unit.

This information signal can be used to inform a luminaire or a sensor provided to control this luminaire about the integrity and the status of the central control unit. For example, the information signal can be distributed by the central control unit in predetermined time intervals, for example, every ten seconds, indicating that the central control unit works properly. In case the local FCUs do not receive the information signal anymore, this can be taken as a clear indication that the central control unit fails to operate or is unreachable. In this case the system switches automatically into the fallback mode, as described above. The information signal can also be polled by the local control units from the central control unit and in case the polling of the information signal fails, the system switches into the fallback mode.

More preferably, in the standard operation mode, the luminaires are controlled by the central control unit according to a standard control algorithm corresponding to a set of standard operation commands, and said fallback control unit operates on the basis of fallback operation commands representing a subset of said set of standard operation commands.

According to another aspect of the present invention, a lighting system is provided comprising a plurality of luminaires, a plurality of sensors, a central control unit, and a network comprising networking devices for establishing a communication between the luminaires, the sensors and the central control unit, said central control unit being provided to control the luminaires on the basis of sensor data transmitted from the sensors to the central control unit in a standard operation mode, and said luminaires and/or said sensors being provided with a FCU to control the luminaires in case of failure of operation of the central control unit or in case of networking interruption between the central control unit and the luminaires or sensors in a fallback mode.

According to a preferred embodiment of this lighting system, each luminaire being provided with said FCU is provided to be controlled on the basis of sensor data received from a sensor whose network address is stored in the FCU of the respective luminaire.

According to another preferred embodiment, each sensor being provided with said FCU is provided to control at least one luminaire on the basis of sensor data provided by this sensor, the network address of the luminaire to be controlled being stored in the FCU of this sensor.

According to still another embodiment of this system, the central control unit is provided to send information signals from the central control unit to the luminaires and/or said sensors being provided with said FCU indicating the operational status of the central control unit.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Figure 1:
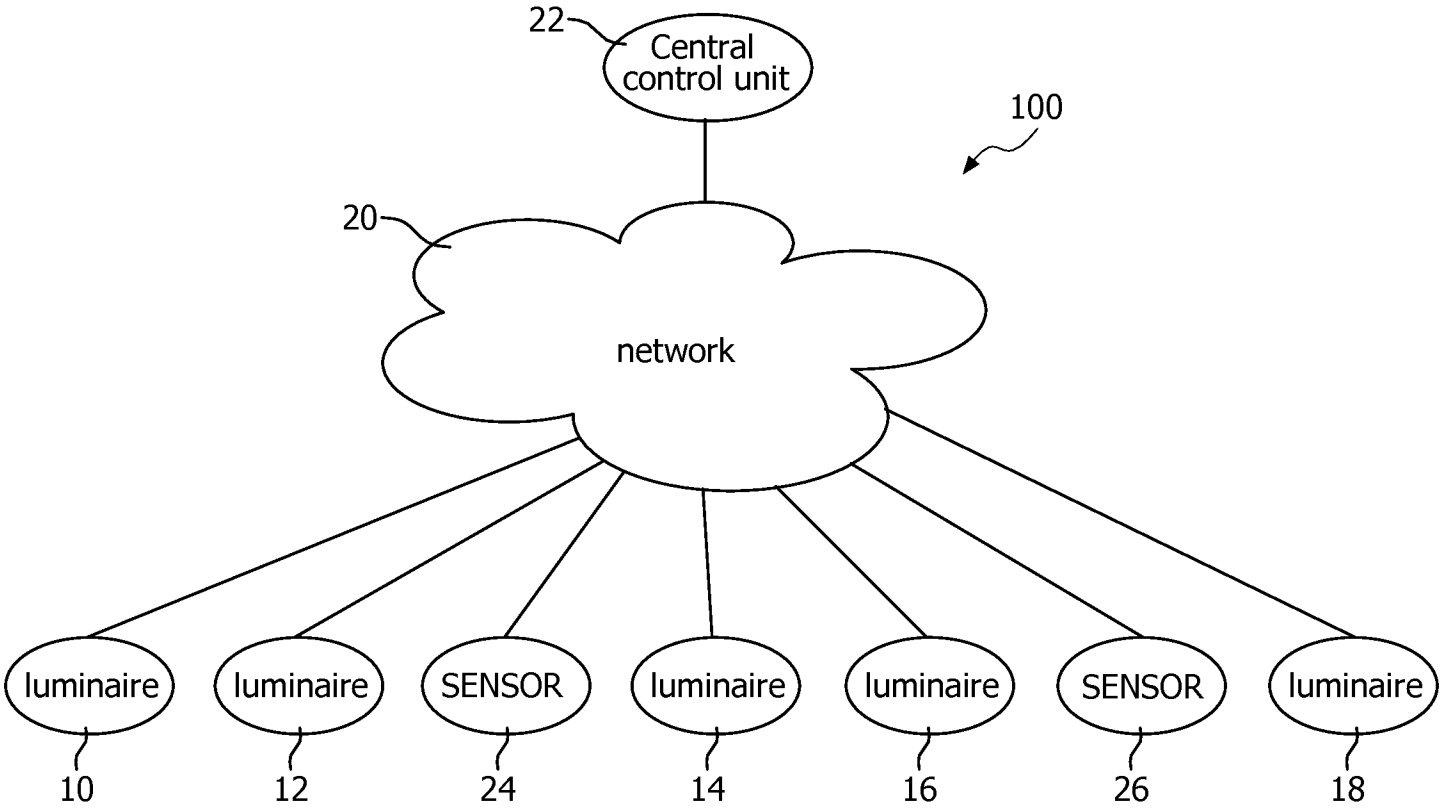
FIG. 1 shows a lighting system with an architecture corresponding to the state of the art.

FIG. 1 shows a conventional lighting system 100 comprising a plurality of luminaires 10, 12, 14, 16, 18, two sensors 24, 26, a central control unit 22 and a network 20 comprising networking devices like routers or switches (not shown in FIG. 1) for establishing a communication between the luminaires 10, 12, 14, 16, 18, the sensors 24, 26 and the central control unit 22. The luminaires 10, 12, 14, 16, 18 are arranged, for example, in different rooms on different floors of an office building. Each room can comprise more than one luminaire 10, 12, 14, 16, 18. For example, the luminaires 10 and 12 can be arranged in a first room, while the luminaires 14, 16 and 18 are arranged in a second room. In each of these first and second rooms, one sensor 24 and 26 is disposed. The first sensor 24 is arranged to provide sensor data for controlling the luminaires 10 and 12 disposed in the same room. For example, the sensor 24 can be a presence detection sensor detecting the presence of persons in this room, and the operation of the luminaires 10 and 12 can be controlled accordingly. In the same way, the second sensor 26 in the second room provides sensor data to control the luminaires 14, 16 and 18.

The control commands for controlling the luminaires 10, 12, 14, 16, 18 are provided by one single central control unit 22 shown in the upper part of FIG. 1. The central control unit 22 receives the sensor data from the sensors 24 and 26 that are transmitted by the network 20 to the central control unit 22. The central control unit 22 comprises a control functionality to calculate control commands on the basis of the received sensor data. For example, the central control unit 22 comprises a central processing device, a memory and other peripheral units to carry out an algorithm to calculate the control commands.

These control commands are sent from the central control unit 22 via the network 20 to the respective luminaires 10, 12, 14, 16, 18. That is, the central control unit 22 calculates control commands for the luminaires 10, 12 on the basis of sensor data received from the sensor 24 and sends control commands to the luminaires 14, 16, 18 that are calculated on the basis of sensor data from the sensor 26.

The architecture of the network 20 can be chosen suitably for the desired purpose. For example, the network 20 can be an IP (Internet protocol) network 20, and all units of the lighting system shown in FIG. 1 are provided with an individual IP address to be identified by the network 20. For example, each of the luminaires 10, 12, 14, 16, 18 and each of the sensors 24, 26 is provided with an individual IP address. By sending a control command to a luminaire 10, 12, 14, 16, 18 with a corresponding IP address, the central control unit 22 addresses the respective luminaires 10, 12, 14, 16, 18 to be controlled. It is noted that other network types or architectures can be used for any desired purpose.

In case the central control unit 22 fails to operate or is unreachable, the luminaires 10, 12, 14, 16, 18 do not receive control commands from the central control unit 22, and consequently it is not possible to control the luminaires 10, 12, 14, 16, 18 further. For this reason the conventional lighting system shown in FIG. 1 is not failsafe and does not provide the desired robustness and stability for professional applications.

Figure 2:
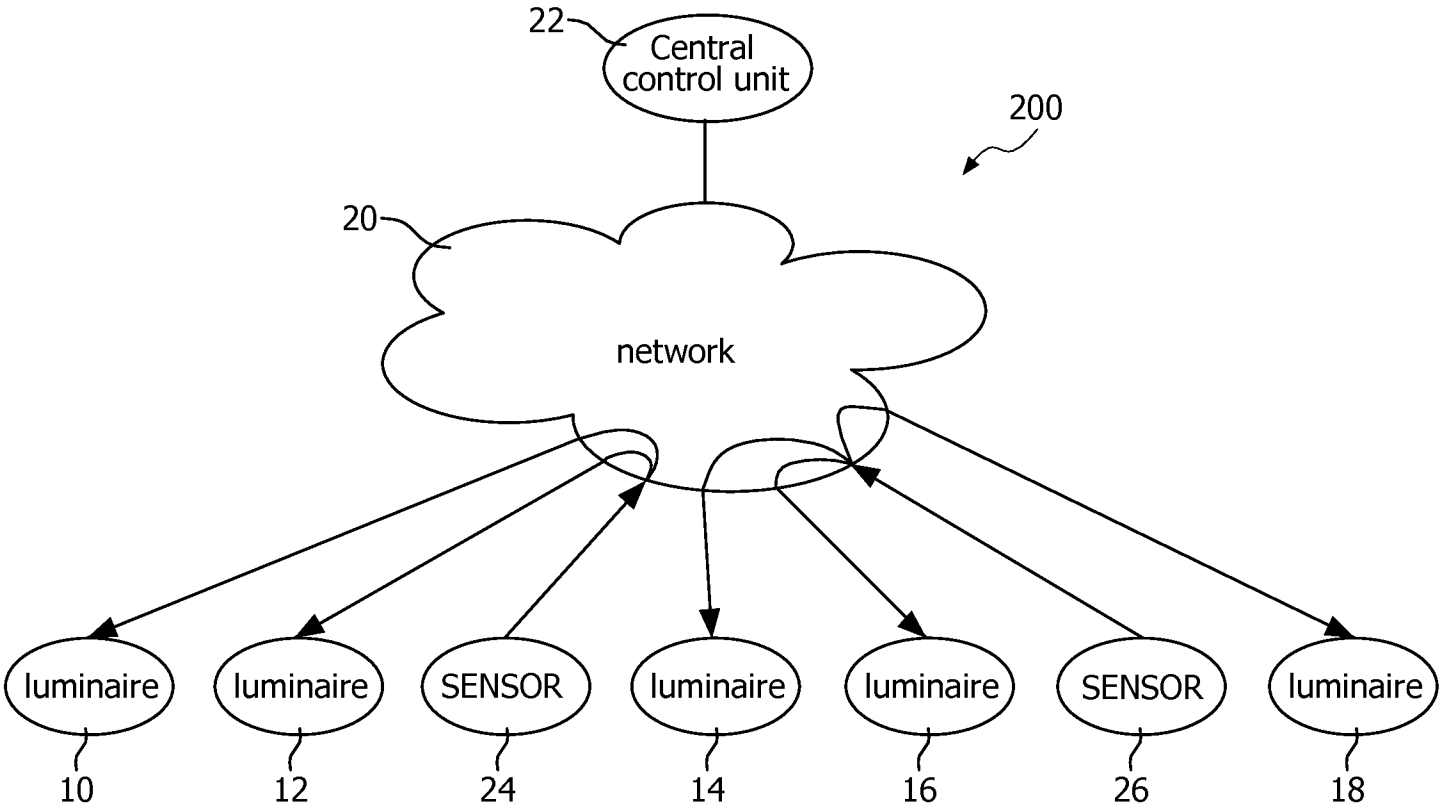
FIG. 2 shows schematically the function of a lighting system according to an embodiment of the present invention.

The lighting system 200 shown in FIG. 2, representing an embodiment of the present invention, is improved under the aspect of robustness and stability, as will be explained in the following. Note that all components similar to FIG. 1 are designated by the same reference numbers. This relates to the luminaires 10, 12, 14, 16, 18, the sensors 24, 26, the network 20 and the central control unit 22 as well.

Like in the conventional lighting system 100 in FIG. 1, a single central control unit 22 is provided to receive sensor data from the sensors 24, 26 and to address control commands to the luminaires 10, 12, 14, 16, 18 that are calculated on the basis of the respective sensor data. Sensor data as well as the control commands are transmitted via the network 20. This operation, representing a conventional operation like described above with reference to the lighting system of FIG. 1, represents a standard operation mode of the lighting system 200 of FIG. 2. Under normal operation conditions the central control unit 22 is used to control the luminaires 10, 12, 14, 16, 18.

Apart from this standard operation mode, the lighting system 200 can switch into a fallback mode in case of failure of operation of the central control unit 22. In the fallback mode, it is possible to control the operation of the luminaires 10, 12, 14, 16, 18 without the use of the central control unit 22.

In the standard operation mode, the operational status of the central control unit 22 is regularly checked. For this purpose the luminaires 10, 12, 14, 16, 18 send regular "acknowledgement requests" to the central control unit 22. These requests can be sent in regular time intervals, for example, every ten seconds. Once the central control unit 22 receives such a request, it answers with an information signal that is sent from the central control unit 22 to the luminaire 10, 12, 14, 16, 18 from which the acknowledgement request has been received. In the case of integrity and proper operation of the central control unit 22, the central control unit 22 sends an information signal indicating this integrity. However, in case of failure of operation of the central control unit 22, no information signal is sent to luminaires 10, 12, 14, 16, 18, or a signal is emitted by the central control unit 22 indicating the failure of operation.

Once a luminaire 10, 12, 14, 16, 18 does not receive further information signals indicating the regular operation of the central control unit 22, it switches into a fallback mode to be controlled without the help of the central control unit 22. For this purpose each luminaire 10, 12, 14, 16, 18 is provided with a local control functionality implemented into the luminaire 10, 12, 14, 16, 18 itself. This control functionality is represented by a fallback control unit (FCU) allocated in the luminaire. The FCU can be implemented as a control algorithm (i.e. fallback control algorithm) stored in a local memory of the luminaire. However, the local fallback control unit can also be represented by a hardware device (i.e. an additional hardware unit or the usual hardware implemented into the respective luminaire 10, 12, 14, 16, 18) to perform a respective fallback control algorithm. This fallback control algorithm is able to control basic functions of the luminaire 10, 12, 14, 16, 18 (for example, to turn it on or off) on the basis of sensor data received from a sensor 24, 26 associated to this luminaire 10, 12, 14, 16, 18.

For example, when one of the luminaires 10, 12 does not receive an information signal from the central control unit 22 indicating that the central control unit 22 works regularly, it switches into the fallback mode to be controlled by the FCU allocated in the luminaire 10, 12. The IP address of the sensor 24 associated to this luminaire 10, 12, i.e. that is arranged in the same room, is also stored in the memory of the FCU of this luminaire 10, 12. The luminaires 10, 12 can then poll sensor data from their associated sensors 24, which transmit these sensor data to the luminaires 10, 12 so that the fallback control unit can calculate control commands on the basis of these data.

It is noted that the FCU allocated locally in the luminaires 10, 12, 14, 16, 18 is only a simplified version of the control algorithm performed by the central control unit 22. For example, a set of fallback control commands that can be performed by the luminaires 10, 12, 14, 16, 18 independently is only a subset of a larger number of standard control commands that can be sent by the central control unit 22 to the luminaires 10, 12, 14, 16, 18. This makes it possible to equip the luminaires 10, 12, 14, 16, 18 only with a simplified basic hardware to perform basic control functions.

According to the present invention, the control of the luminaires 10, 12, 14, 16, 18 can be dislocated from the central control unit 22 to local control units of the lighting system 200. For this purpose these local control units are provided to perform a local control functionality. In the embodiment described above, these local units are allocated in the luminaires 10, 12, 14, 16, 18 themselves. However, this local control functionality can also be allocated in other local units of the lighting system 200, as will be described in the following.

The local units to control the luminaires 10, 12, 14, 16, 18 in the fallback mode can also be allocated in the sensors 24 and 26 associated to these luminaires 10, 12, 14, 16, 18. In this case the sensors 24 and 26 are equipped with a local control device, e.g. a memory and processing hardware to perform a fallback control algorithm, producing control commands to be transmitted to the respective luminaires 10, 12, 14, 16, 18 to which the sensors 24, 26 are associated. The respective IP addresses of the luminaires 10, 12, 14, 16, 18 to be controlled by the sensors 24, 26 are also stored in the local memory of the sensors 24, 26. During the standard operation mode, the sensors 24, 26 send regular "acknowledgement requests" to the central control unit 22 via the network 20, as described above.

As a reaction to these requests, the central control unit 22 replies an information signal to the sensors 24, 26 indicating the regular operation of the central control unit 22. However, in case of failure of operation of the central control unit 22, the sensors 24, 26 do not receive the information signal indicating the integrity of the central control unit 22 and switch to the fallback mode to control the respective luminaires 10, 12, 14, 16, 18. On the basis of the sensor data of the sensors 24, 26, these sensors 24, 26 calculate control commands to be sent to the luminaires 10, 12, 14, 16, 18.

It is noted that the information signal showing the integrity of the central control unit 22 does not have to be sent by the central control unit 22 to a reaction to an acknowledgement request of a local control unit. The central control unit 22 can rather emit such regular information signals independently without the reception of acknowledgement requests to indicate that it is still operational.

The general architecture of the lighting system 200 according to the present invention provides a "backup" system to control the luminaires 10, 12, 14, 16, 18 in case of a failure of the central control unit 22 with minimal hardware requirements, as the FCUs taking over the control in the fallback mode can be implemented as software algorithms. Generally it will be possible to carry out the method according to the present invention without adding supplementary central control units to the lighting system. The extra costs and the complexity of the architecture of the lighting system 200 will therefore be kept low.

The present invention can also be applied not only to lighting systems but also to other types of building maintenance systems, like, for example, HVAC-Systems to control the climate and temperature conditions in the rooms of a building.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. Method for controlling a lighting system, said lighting system comprising a plurality of luminaires, a plurality of sensors, a central control unit, and a network establishing a communication between the luminaires, the sensors and the central control unit, wherein in a standard operation mode, the luminaires are controlled by the central control unit on the basis of sensor data transmitted from the sensors to the central control unit and according to a standard control algorithm corresponding to a set of standard operation commands, wherein in case of failure of operation of the central control unit or networking interruption between the central control unit and the luminaires or sensors, the lighting system switches into a fallback mode wherein each luminaire is controlled by a fallback control unit allocated in the luminaire or in a sensor associated to the luminaire, wherein in the case of said fallback control unit being allocated in the luminaire, the luminaire is controlled in the fallback mode on the basis of sensor data received from a sensor whose network address is stored in the fallback control unit of said luminaire, and wherein in the case of said fallback control unit being allocated in a sensor associated to a luminaire to be controlled by this sensor, this luminaire is controlled in the fallback mode on the basis of sensor data provided by this sensor, the network address of the luminaire to be controlled being stored in the fallback control unit of the sensor, and wherein in said fallback mode, said fallback control unit operates according to a set of fallback operation commands representing a subset of said set of standard operation commands.

2. The method according to claim 1, wherein in the case of said fallback control unit being allocated in the luminaire, before starting the operation of the lighting system, the fallback control unit is configured and the network address of the sensor from which the sensor data are received is stored in the fallback control unit of the luminaire in a commissioning phase.

3. The method according to claim 1, wherein in the case of said fallback control unit being allocated in a sensor associated to a luminaire to be controlled by this sensor, before starting the operation of the lighting system, the fallback control unit is configured and the network address of a luminaire to be controlled by a sensor is stored in fallback control unit of this sensor in a commissioning phase.

4. The method according to claim 1, wherein the central control unit regularly sends an information signal from the central control unit to a luminaire or to a sensor equipped with the fallback control unit indicating the operational status of the central control unit.

5. Lighting system, comprising:

a plurality of luminaires, a plurality of sensors, a central control unit, and a network establishing a communication between the luminaires, the sensors and the central control unit, said central control unit being provided to control the luminaires on the basis of sensor data transmitted from the sensors to the central control unit in a standard operation mode and according to a standard control algorithm corresponding to a set of standard operation commands, and said luminaires and/or said sensors being provided with a fallback control unit to control the luminaires in case of failure of operation of the central control unit or in case of networking interruption between the central control unit and the luminaires or sensors in a fallback mode, wherein each luminaire that is provided with said fallback control unit is provided to be controlled on the basis of sensor data received from a sensor whose network address is stored in the fallback control unit of the respective luminaire, and wherein each sensor that is provided with said fallback control unit is provided to control at least one luminaire on the basis of sensor data provided by this sensor, the network address of the luminaire to be controlled being stored in the fallback control unit of this sensor, and wherein in said fallback mode, said fallback control unit operates according to a set of fallback operation commands representing a subset of said set of standard operation commands.

6. Lighting system according to claim 5 wherein the central control unit is provided to send information signals from the central control unit to the luminaires and/or said sensors are provided with said fallback control unit that indicates the operational status of the central control unit.

* * * * *